US008626049B2

(12) United States Patent
Nakane et al.

(10) Patent No.: US 8,626,049 B2
(45) Date of Patent: Jan. 7, 2014

(54) LUBRICANT APPLICATION DEVICE AND IMAGE FORMING APPARATUS

(75) Inventors: Yoshiki Nakane, Toyokawa (JP); Kuniaki Kashiwakura, Toyohashi (JP); Ikuko Kanazawa, Hino (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 170 days.

(21) Appl. No.: 13/063,067

(22) PCT Filed: Aug. 14, 2009

(86) PCT No.: PCT/JP2009/064355
§ 371 (c)(1),
(2), (4) Date: Mar. 9, 2011

(87) PCT Pub. No.: WO2010/032572
PCT Pub. Date: Mar. 25, 2010

(65) Prior Publication Data

US 2011/0164909 A1 Jul. 7, 2011

(30) Foreign Application Priority Data

Sep. 18, 2008 (JP) ..... 2008-239035

(51) Int. Cl.
*G03G 21/00* (2006.01)

(52) U.S. Cl.
USPC ..... 399/346; 399/353

(58) Field of Classification Search
USPC ..... 399/346
See application file for complete search history.

(56) References Cited

U.S. PATENT DOCUMENTS

| | | | | |
|---|---|---|---|---|
| 5,111,251 | A * | 5/1992 | Uno et al. | 399/349 |
| 6,219,505 | B1 * | 4/2001 | Sato et al. | 399/98 |
| 2004/0202495 | A1 * | 10/2004 | Koike et al. | 399/159 |
| 2007/0071525 | A1 * | 3/2007 | Yoshino et al. | 399/346 |
| 2007/0154246 | A1 * | 7/2007 | Shintani et al. | 399/346 |
| 2009/0041502 | A1 * | 2/2009 | Komatsu | 399/175 |
| 2009/0185842 | A1 * | 7/2009 | Hatori et al. | 399/346 |

FOREIGN PATENT DOCUMENTS

| | | | |
|---|---|---|---|
| JP | 03-116083 | A | 5/1991 |
| JP | 03116083 | A * | 5/1991 |
| JP | 05-297770 | A | 11/1993 |
| JP | 08-254933 | A | 10/1996 |

(Continued)

OTHER PUBLICATIONS

International Search Report (PCT/ISA/210) issued on Sep. 15, 2009, by Japanese Patent Office as the International Searching Authority for International Application No. PCT/JP2009/064355, and an English Translation thereof.
Office Action (Notice of Reason for Rejection) dated Sep. 8, 2009, issued in the corresponding Japanese Patent Application No. 2008-239035, and an English Translation thereof.

(Continued)

*Primary Examiner* — David Gray
*Assistant Examiner* — Tyler Hardman
(74) *Attorney, Agent, or Firm* — Buchanan Ingersoll & Rooney PC

(57) ABSTRACT

In the lubricant application device, including a brush roller which rotates while contacting an image carrying member and a solid lubricant, shaves the solid lubricant and applies the shaved solid lubricant onto the image carrying member, and a flicker which abuts against the brush roller and knocks off a developer adhering to the brush roller through a rotation of the brush roller, the brush roller has looped bristles implanted in a state of endless loop, and the flicker has a contact surface which forms an acute angle.

8 Claims, 3 Drawing Sheets

(56) References Cited

FOREIGN PATENT DOCUMENTS

| | | | | |
|---|---|---|---|---|
| JP | 09-050215 | A | | 2/1997 |
| JP | 09-054531 | A | | 2/1997 |
| JP | 09050215 | A | * | 2/1997 |
| JP | 2002-278403 | A | | 9/2002 |
| JP | 2005-230732 | A | | 9/2005 |
| JP | 2005230732 | A | * | 9/2005 |
| JP | 2007-289611 | A | | 11/2007 |
| JP | 2007-310121 | A | | 11/2007 |
| JP | 2007310121 | A | * | 11/2007 |

OTHER PUBLICATIONS

Supplementary European Search Report dated Mar. 2, 2012, issued in the corresponding European Patent Application No. 09814417.3. (6 pages).

Notification of Transmittal of Translation of the International Preliminary Report on Patentability (Forms PCT/IB/338 and PCT/IB/373) and the Written Opinion of the International Searching Authority (Form PCT/ISA/237) issued on Apr. 28, 2011, in the corresponding International Application No. PCT/JP2009/064355.

* cited by examiner

LUBRICANT APPLICATION DEVICE AND IMAGE FORMING APPARATUS

TECHNICAL FIELD

The present invention relates to a lubricant application device which applies a solid lubricant onto an image carrying member and an image forming apparatus.

BACKGROUND ART

In electrophotographic image forming apparatuses, it is widely performed to press a cleaning blade against the surface of an image carrying member to scrape a toner remaining on the image carrying member. Lubricant application devices, in which in order to reduce the friction between the image carrying member and the cleaning blade in scraping the toner, a brush roller rotating while contacting the image carrying member and a solid lubricant, shaves the solid lubricant and applies the shaved solid lubricant onto the image carrying member, are publicly known.

Furthermore, in Patent Documents 1 and 2, there is disclosed a technical idea in which a flicker abutting against the brush roller is disposed in the lubricant application device and the flicker knocks off a developer adhering to the brush roller through a rotation force of the brush roller.

In conventional lubricant application devices, the brush roller in which rigid brushes made of a resin are implanted are employed, but this brush roller tends to supply an insufficient solid lubricant since it shaves the solid lubricant in streak form. Therefore, it is investigated to scrape the solid lubricant uniformly by applying a brush roller having many soft brushes like a raised cloth wound around a shaft to stabilize lubrication performance. However, this method has a problem that when the flicker is used for the soft brushes, brushes are damaged and therefore it becomes impossible to scrape and apply the lubricant properly.

Patent Document 1: Japanese Unexamined Patent Publication No. 2002-278403

Patent Document 2: Japanese Unexamined Patent Publication No. 9-54531

DISCLOSURE OF THE INVENTION

Problems to be Solved by the Invention

In view of the above problem, it is an object of the present invention to provide a lubricant application device and an image forming apparatus which can shave a solid lubricant evenly and can knock off a developer with a flicker.

Means for Solving the Problems

To solve the above problem, the lubricant application device according to the present invention includes a brush roller which rotates while contacting an image carrying member and a solid lubricant, shaves the solid lubricant and applies the shaved solid lubricant onto the image carrying member, and a flicker which abuts against the brush roller and knocks off a developer adhering to the brush roller through a rotation of the brush roller, wherein the brush roller has looped bristles implanted in a state of endless loop, and wherein the flicker has a contact surface which forms an acute angle with a direction of a tangent line on an upstream side in a rotation direction of the brush roller.

In accordance with this constitution, the solid lubricant can be evenly shaved by the looped bristles. Further, since the looped bristles abut surely against the contact surface of the flicker first, they are not damaged by a tip edge of the flicker.

Further, in the lubricant application device of the present invention, when an angle between the contact surface and a rotation direction of the brush roller is 5° or more, the flicker has a sufficient effect of knocking off a developer adhering to the looped bristles, and when the angle between the contact surface and the rotation direction of the brush roller is 70° or less, damages to the looped bristles can be reduced.

Further, in the lubricant application device of the present invention, when the looped bristle has the inclination of 30° or more with respect to a direction of a rotation axis of the brush roller, damages to the looped bristles by the flicker can be reduced. Moreover, when an inclination of the looped bristles with respect to a direction of a rotation axis of the brush roller is 60° or less, the solid lubricant can be adequately shaved.

The lubricant application device according to the present invention, in the looped bristles, a plurality of fibers may be twined with each other and implanted.

In accordance with this constitution, since the rigidity of a bundle of the loops becomes high, the solid lubricant can be moderately scraped.

The lubricant application device according to the present invention, the brush roller further has auxiliary looped bristles in which fibers are not twined with each other and implanted in a state of endless loop.

Since a bundle of the auxiliary looped bristle, which are not twined, has low rigidity, it has a weak action of scraping the solid lubricant, but it is less prone to being damaged by the flicker. By implanting such the auxiliary looped bristles to fill in a gap between the looped bristles which are twined, the attitude of the looped bristles can be held.

The image forming apparatus according to the present invention includes any of the above-mentioned lubricant application devices.

Effect of the Invention

As described above, the lubricant application device according to the present invention succeeds in reducing the damages of the brush roller while knocking off the developer from the brush roller by using a brush roller having looped bristles implanted in a state of endless loop and providing a flicker having a contact surface which forms an acute angle with a direction of a tangent line on an upstream side in a rotation direction of the brush roller. Thereby, in the lubricant application device of the present invention, consumption of the solid lubricant is uniform and the brush roller has a long-life.

DESCRIPTION OF EMBODIMENT

Figure 1:
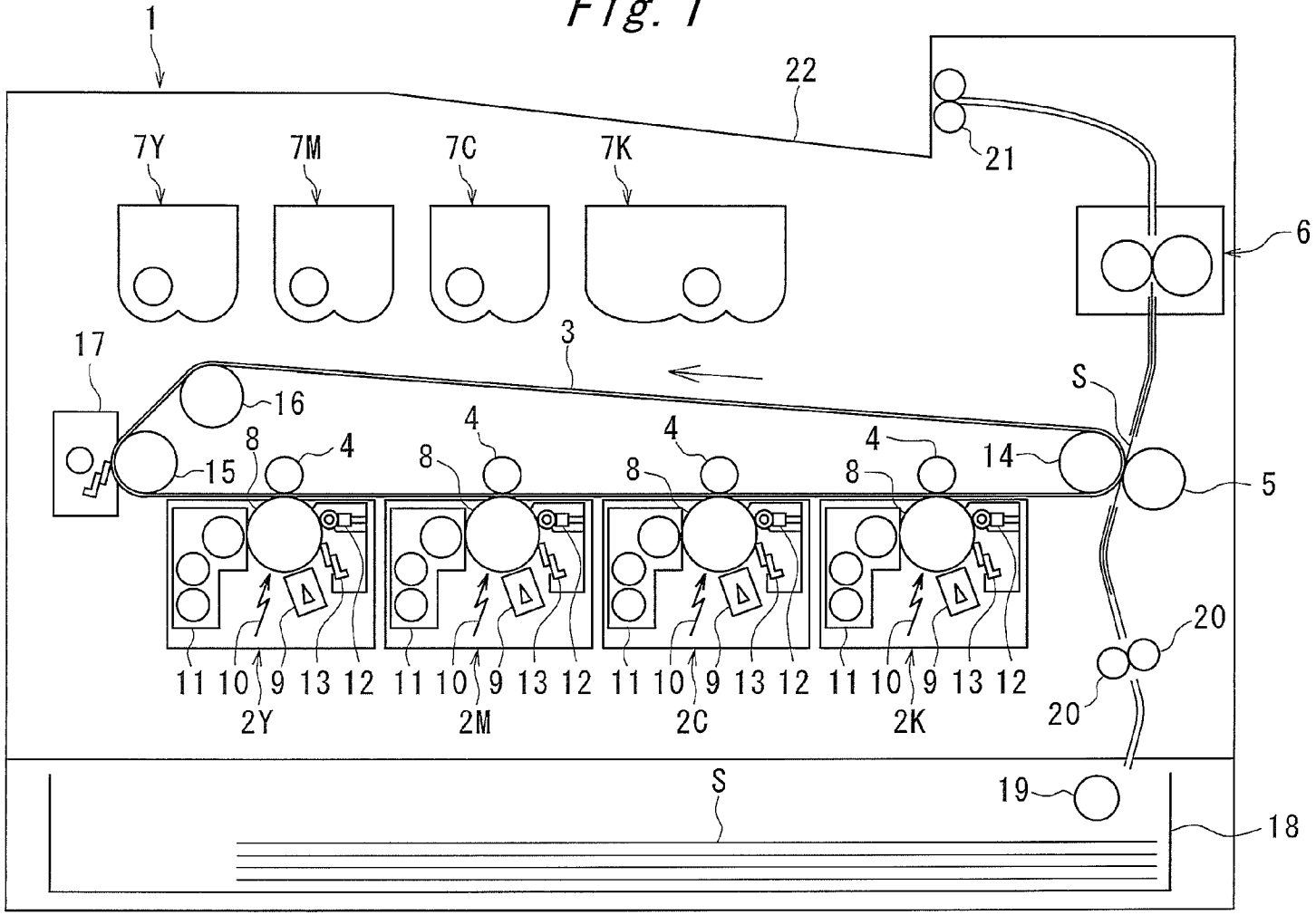
FIG. 1 is a schematic view of an image forming apparatus of an embodiment of the present invention.

Hereinafter, embodiments of the present invention will be described referring to the drawings. FIG. 1 shows an image forming apparatus 1 of a first embodiment of the present invention. The image forming apparatus 1 has four developing units 2Y, 2M, 2C, and 2K which form an image by toners (developers) of yellow, magenta, cyan, and black, respectively, having negative charges, a transfer belt 3, a primary transfer roller 4 to transfer toner images which the developing units 2 form to the transfer belt 3 through an electrostatic force, a secondary transfer roller 5 to transfer toner images transferred to the transfer belt 3 to a recording paper S through an electrostatic force, a fixing device 6 to fix the toner images by heating the recording paper S, and four toner cartridges 7Y, 7M, 7C, 7K to supply toners of yellow, magenta, cyan, and black, respectively, to the developing units 2.

Each of the developing units 2Y, 2M, 2C, and 2K has a drum-shaped photoconductor (image carrying member) 8 to rotate, a charging unit 9 to cause the photoconductor 8 to be charged, an exposure unit 10 which selectively exposures the charged photoconductor 8 to form an electrostatic latent image, a developing unit 11 which supplies toner to the electrostatic latent image to form toner images, a lubricant application device 12 of the present invention which applies a lubricant onto the surface of the photoconductor 8, and a cleaning blade 13 to scrape the toner on the surface of the photoconductor 8.

The transfer belt 3 is looped over a drive roller to be rotationally driven, a driven roller 15 and a tension roller 16 to give tension and the transfer belt 3 is moved around these rollers in a direction of an arrow by the driving roller 14. Further, the image forming apparatus 1 has a cleaner unit 17 which scrapes toner remaining on the surface of the transfer belt 3.

The recording papers S are supplied to a paper feeding section 18, and each recording paper is sent out one by one by a supply roller 19, conveyed to a secondary transfer roller 5 by a conveying roller 20, passes through a fixing device 6, and discharged to a paper-discharging section 22 by a paper-discharging roller 21.

Figure 2:
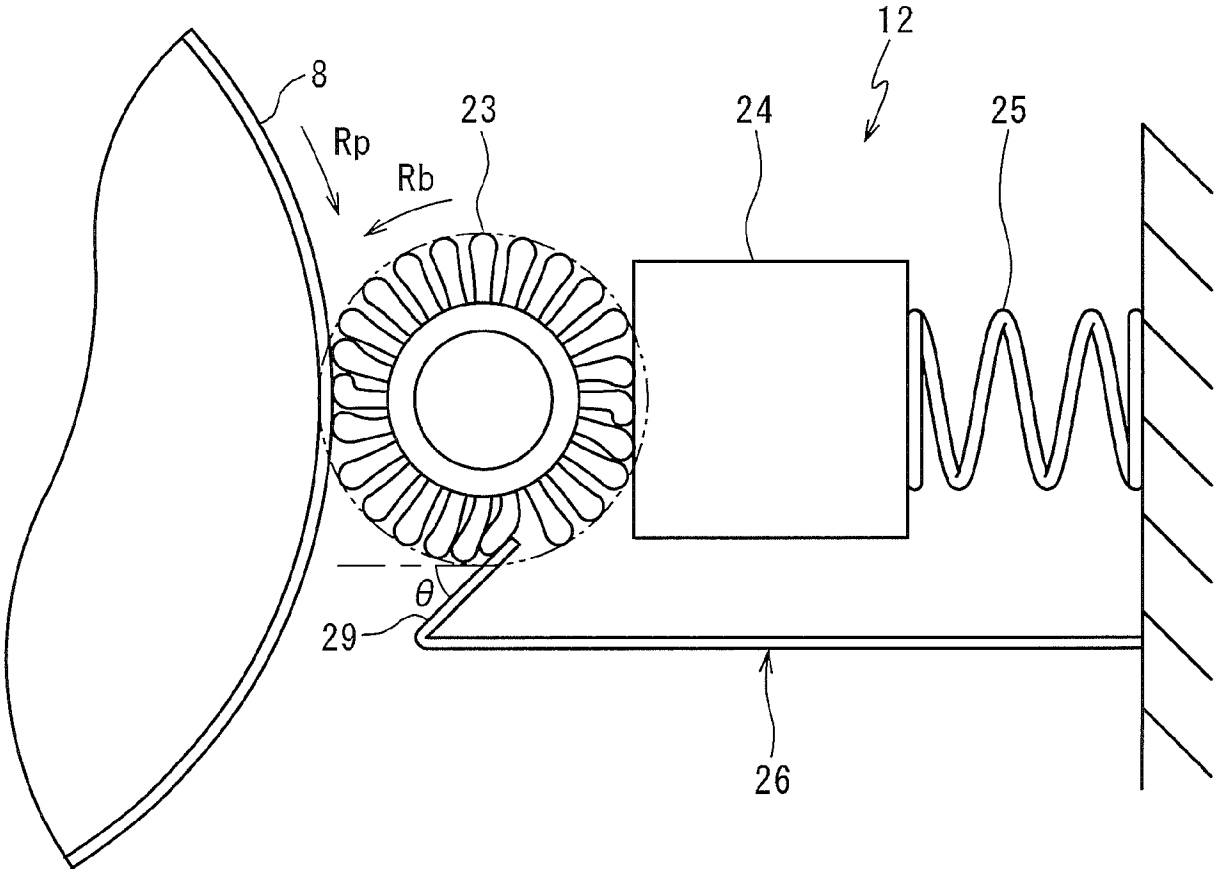
FIG. 2 is a schematic view of a lubricant application device off FIG. 1.

Details of the photoconductor 8 and the lubricant application device 12 are shown in FIG. 2. The lubricant application device 12 includes a brush roller 23 to rotate, a solid lubricant 24 formed by solidifying, for example, zinc stearate, a biasing member 25 which presses the solid lubricant 24 against the brush roller 23 with a predetermined force (for example, 1 to 4 N/m), and a flicker 26 to abut against the brush roller 23.

The photoconductor 8 has an overcoat layer in which $SiO_2$ fine particles are dispersed and is rotated in a direction of an arrow Rp. The photoconductor 8 and the lubricant application device 12 are respectively positioned in such a manner that the photoconductor 8 dents in the brush roller 23 by about 0.5 mm. The brush roller 23 rotates in a direction of an arrow Rb in a manner of being rotated following the rotation of the photoconductor 8.

Figure 3:
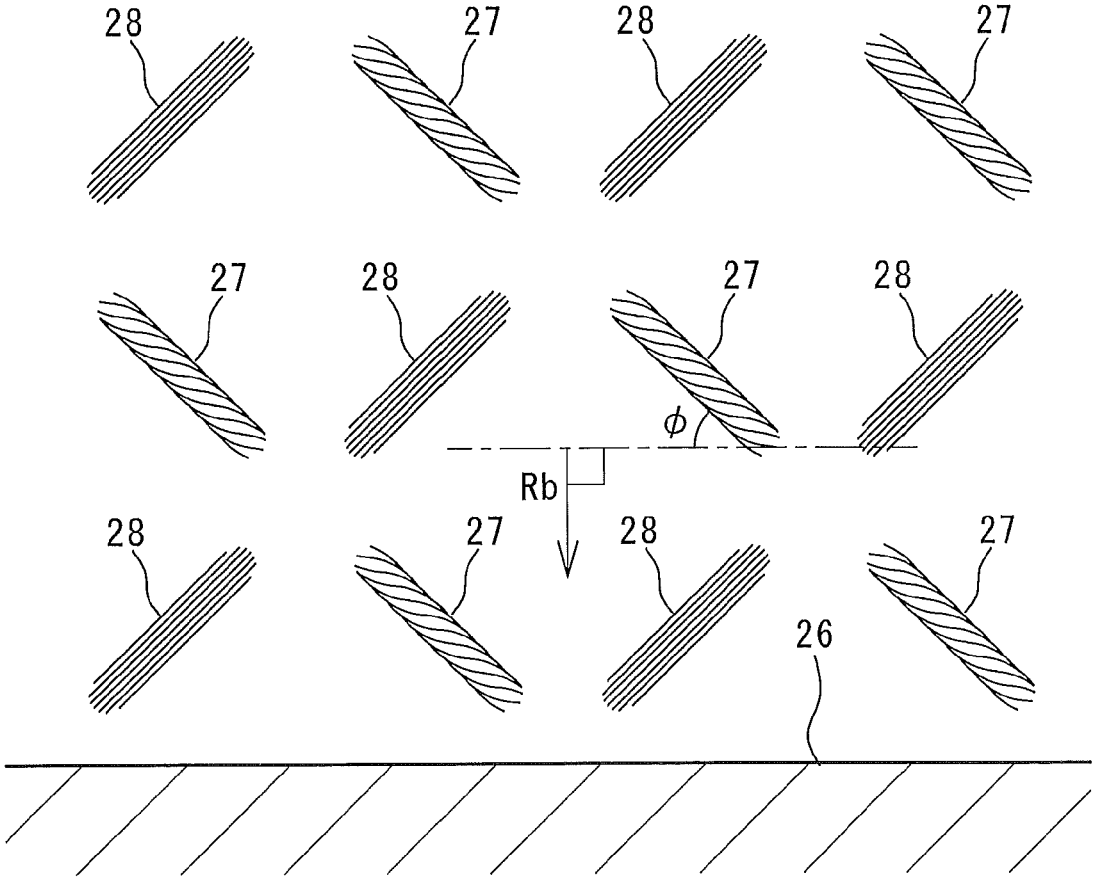
FIG. 3 is a detail view of looped bristles of a lubricant application device off FIG. 2.

The brush roller 23 is formed, for example, by winding a base cloth having a thickness of 0.5 mm, in which a bundle of conductive polyester fibers is woven and implanted in the shape of loop of 2.5 mm in height, around a metal shaft of 6 mm in outside diameter. These fibers are implanted as a bundle of 48 fibers, and as shown in FIG. 3, the looped bristles 27 composed of fibers twined with each other and the auxiliary looped bristles 28 composed of fibers not twined are alternately arranged so as to be orthogonal to each other and implanted. This base cloth is wound around the shaft in such a manner that a loop direction of the looped bristles 27, which are twined, is angled at an angle $\phi$ with respect to a direction of a rotation axis (a direction orthogonal to a rotation direction Rp) of the brush roller 23, that is, a direction of extension of the flicker. A density of fibers implanted in the base cloth is about 100000 fibers/square inch as a whole and a thickness of a bundle of fibers is about 210 decitex (per 48 fibers).

The flicker 26 is formed by bending a metal plate, has a contact surface 29 which forms an angle $\theta$ with an upstream side in a rotation direction at a periphery of the brush roller 23, and is held in such a manner that a tip edge of the flicker 26 dents in the brush roller 23 by about 0.3 mm, that is, dents in the brush roller 23 to a depth of 120 of a height of the looped bristle.

In the lubricant application device 12, the brush roller 23 shaves the surface of the solid lubricant 24, which is pressed against the brush roller 23 by a biasing member 25, through the rotation of the brush roller 23, and applies the shaved lubricant onto the surface of the photoconductor 8. In this time, since the brush roller 23 has looped bristles 27 in an endless state, the looped bristles 27 abut against the surface of the solid lubricant over a certain length, and each looped bristle 27 scrapes the solid lubricant 24 widely and applies the scraped solid lubricant onto the photoconductor 8. Accordingly, the brush roller 23 does not shave the solid lubricant 24 in the form of a groove as conventional brushes having straight yarn and an amount of the lubricant to be applied does not vary. On the other hand, a bundle of the auxiliary looped bristle 28 has a weak action of scraping the solid lubricant 24 since it has low rigidity because of being not twined. However, the auxiliary looped bristles 28 has the function of holding the attitude of the looped bristles 27 by filling in a gap between the looped bristles 27 to prevent a large deformation of the looped bristle 27.

The lubricant thus applied onto the surface of the photoconductor 8 passes through a nip between the cleaning blade 13 and the photoconductor 8 with rotations of the photoconductor 8 to reduce the friction between the cleaning blade 13 and the photoconductor 8. The toner having a larger particle than that of the lubricant cannot pass through the nip between the cleaning blade 13 and the photoconductor 8 and is scraped from the photoconductor 8 by the cleaning blade 13.

The durability of the image forming apparatus 1 was tested at varying angles $\theta$ between the contact surface 29 of the flicker 26 and an upstream side in a rotation direction of the brush roller 23, and the results of the tests are shown in Table 1. Here, experiments were carried out by setting an angle $\phi$ of a loop direction of the looped bristles 27 with respect to a direction of a rotation axis of the brush roller 23 at 45°. In the durability tests, 600000 sheets of images of 600 dpi were printed at a printing speed of 65 sheets/min using an A4-sized recording paper, and then states of damages to the looped bristles 27 and the auxiliary looped bristles 28 of the brush roller 23 were visually checked, and the capabilities of removing the toner from the brush roller 23 were evaluated by measuring the weight of the brush roller 23.

TABLE 1

| θ(deg) | 0 | 5 | 10 | 25 | 35 | 45 | 60 | 70 | 80 | 90 |
|---|---|---|---|---|---|---|---|---|---|---|
| State of damage | ⊙ | ⊙ | ⊙ | ⊙ | ⊙ | ⊙ | ○ | ○ | Δ | X |
| Removal of toner | X | ○ | ○ | ⊙ | ⊙ | ⊙ | ⊙ | ⊙ | ⊙ | ⊙ |

The states of damages of brush roller 23 can be identified as changes in a hue of the surface, and the case where there was no change in the hue was rated as a symbol ⊙, the case where the change in the hue could be slightly recognized was rated as a symbol ○, the case where the change in the hue was large was rated as a symbol Δ, and the case where the break of the looped bristles 27 could be recognized was rated as a symbol x. Moreover, with respect to the capability of removing the toner, when an increase in weight of the brush roller 23 was 2 g or less, it was rated as a symbol ⊙, and when an increase in weight was 4 g or less, it was rated as a symbol ○, and when an increase in weight was more than 4 g, it was rated as a symbol x.

From this result, it was proven that by adjusting an angle θ between the contact surface 29 of the flicker 26 and a direction of a tangent line on an upstream side in a rotation direction of the brush roller 23 so as to be an acute angle less than 90°, damages to the looped bristles (and the auxiliary looped bristles 28) of the looped bristles 23 can be reduced to a practicable level, and by adjusting the angle θ so as to be 70°or less, damages to the looped bristles 27 can be reduced to a safer level, and by adjusting the angle θ so as to be 45° or less, almost of damages to the looped bristles 27 can be eliminated.

Further, it was also verified that when an angle θ between the contact surface 29 of the flicker 26 and a direction of a tangent line on an upstream side in a rotation direction of the brush roller 23 is 5° or more, the toner adhering to the brush roller 23 can be adequately knocked off by the flicker 26, and when the angle θ is 25° or more, the toner adhering to the brush roller 23 can be knocked off by the flicker 26 with more reliability.

Subsequently, the durability of the image forming apparatus 1 was similarly tested at varying angles ϕ of a loop direction of the looped bristles 27 with respect to a direction of a rotation axis of the brush roller 23, and the results of the tests are shown in Table 2. Here, experiments were carried out by setting the angle θ between the contact surface 29 of the flicker 26 and a direction of a tangent line of the brush roller 23 at 45°. In this experiment, the capability of applying a lubricant was evaluated according to a consumed amount of the lubricant. Specifically, the case where a remaining weight after the durability test of the solid lubricant 24 of 18 g in initial weight was 5 g or less was rated as a symbol O, the case where the remaining weight was 10 g or less was rated as a symbol A, and the case where the remaining weight was more than 10 g was rated as a symbol x.

TABLE 2

| θ(deg) | 30 | 40 | 45 | 50 | 60 | 70 |
|---|---|---|---|---|---|---|
| State of damage | X | ○ | ⊙ | ⊙ | ⊙ | ⊙ |
| consumed amount of lubricant | ○ | ○ | ○ | ○ | Δ | X |

From this result, it was proven that when the angle of the loop direction of the looped bristles 27 with respect to a direction of the rotation axis of the brush roller 23, that is, an abutting angle ϕ with respect to the flicker 26 is more than 30°, damages to the looped bristles can be adequately suppressed, and when the abutting angle ϕ of the looped bristles 27 is less than 70°, a sufficient amount of the lubricant can be applied to the photoconductor 8.

DESCRIPTION OF THE REFERENCE NUMERALS AND SYMBOLS

1 . . . image forming apparatus
8 . . . photoconductor
12 . . . lubricant application device
13 . . . cleaning blade
23 . . . roller brush
24 . . . solid lubricant
25 . . . biasing member
26 . . . flicker
27 . . . looped bristles
28 . . . auxiliary looped bristles
29 . . . contact surface

The invention claimed is:

1. A lubricant application device comprising a brush roller which rotates while contacting an image carrying member and a solid lubricant, shaves said solid lubricant and applies the shaved solid lubricant onto said image carrying member, and a flicker which abuts against said brush roller and knocks off a developer adhering to said brush roller through a rotation of said brush roller, wherein said brush roller has looped bristles implanted in a state of endless loop, each of the looped bristles having a relaxed state when not in contact with the solid lubricant or the flicker; and said flicker has a contact surface which forms an acute angle with a direction of a tangent line on an upstream side in a rotation direction of said brush roller, wherein the flicker is provided upstream of the solid lubricant in the rotation direction of the brush roller at a sufficient distance to allow the looped bristles to assume the relaxed state from a time after contact with the flicker and before contact with the solid lubricant.

2. The lubricant application device according to claim 1, wherein an angle between said contact surface and a rotation direction of said brush roller is 5° or more and 70° or less.

3. The lubricant application device according to claim 1, wherein said looped bristles have the inclination of 30° or more and 60° or less with respect to a direction of a rotation axis of said brush roller.

4. The lubricant application device according to claim 1, wherein in said looped bristles, a plurality of fibers are twined with each other and implanted.

5. The lubricant application device according to claim 4, wherein said brush roller further has auxiliary looped bristles in which fibers are not twined with each other and implanted in a state of endless loop.

6. An image forming apparatus comprising the lubricant application device according to claim 1.

7. The lubricant application device according to claim 1, wherein the solid lubricant is pressed towards the brush roller in a horizontal direction via a biasing member, and the contact surface of the flicker forms an acute angle with the horizontal direction.

8. The lubricant application device according to claim 1, wherein the flicker comprises an elongated base member and the contact surface extends from the base member at an acute angle from the base member.

* * * * *